US007845809B2

(12) United States Patent
Büsing et al.

(10) Patent No.: US 7,845,809 B2
(45) Date of Patent: Dec. 7, 2010

(54) DOMESTIC APPLIANCE, IN PARTICULAR FITTED DOMESTIC APPLIANCE WITH A CONTROLLABLE OPERATING DISPLAY

(75) Inventors: Johannes Büsing, Emersacker (DE); Daniel Delle, Bächingen (DE); Gerhard Fetzer, Gundelfingen (DE); Peter Geissler, Holzheim (DE); Norbert Gerstner, Heidenheim (DE); Hubert Groll, Mödingen (DE); Mathias Herrmann, Dischingen (DE); Dieter Hotz, Dischingen (DE); Stefan Kasbauer, Dillingen (DE); Michael Rosenbauer, Reimlingen (DE); Bernd Schessl, Dillingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 252 days.

(21) Appl. No.: 12/086,201

(22) PCT Filed: Oct. 2, 2006

(86) PCT No.: PCT/EP2006/066968

§ 371 (c)(1),
(2), (4) Date: Jun. 5, 2008

(87) PCT Pub. No.: WO2007/093230

PCT Pub. Date: Aug. 23, 2007

(65) Prior Publication Data

US 2009/0129114 A1 May 21, 2009

(30) Foreign Application Priority Data

Oct. 6, 2005 (DE) ..... 10 2005 047 915

(51) Int. Cl.
*F21V 33/00* (2006.01)

(52) U.S. Cl. ..... 362/92; 362/89; 362/91

(58) Field of Classification Search ..... 362/89, 362/91, 92, 94, 147
See application file for complete search history.

(56) References Cited

U.S. PATENT DOCUMENTS

| | | | | |
|---|---|---|---|---|
| 2,737,573 | A * | 3/1956 | Olthuis | 362/91 |
| 5,836,669 | A * | 11/1998 | Hed | 362/92 |
| 6,700,500 | B1 * | 3/2004 | Burnett | 340/686.6 |
| 7,308,186 | B2 * | 12/2007 | Kaczmarek | 385/147 |
| 7,320,528 | B2 * | 1/2008 | Gotz | 362/94 |
| 2001/0045226 | A1 | 11/2001 | Todd | |
| 2005/0024849 | A1 | 2/2005 | Parker et al. | |

(Continued)

FOREIGN PATENT DOCUMENTS

DE 101 44 668 3/2003

(Continued)

OTHER PUBLICATIONS

International Search Report PCT/EP2006/066968.

*Primary Examiner*—Stephen F Husar
*Assistant Examiner*—James W Cranson
(74) *Attorney, Agent, or Firm*—James E. Howard; Andre Pallapies

(57) ABSTRACT

A domestic appliance includes an operation indicator having an illumination element for emitting a light beam by means of which a gap between the domestic appliance and a surface adjacent to the domestic appliance can be illuminated, and a reflection element in the gap for directing or bundling light emitted by the illumination element.

21 Claims, 4 Drawing Sheets

U.S. PATENT DOCUMENTS

| | | | | |
|---|---|---|---|---|
| 2006/0280422 | A1 | 12/2006 | Kaczmarek | |
| 2007/0069979 | A1 | 3/2007 | Rosenbauer et al. | |
| 2009/0080178 | A1 * | 3/2009 | Wilsdorf | 362/92 |

FOREIGN PATENT DOCUMENTS

| | | |
|---|---|---|
| DE | 102 36 211 | 2/2004 |
| DE | 103 03 354 | 8/2004 |
| DE | 20 2004 017 690 U | 2/2005 |
| EP | 0 691 100 | 1/1996 |
| EP | 1 151 717 | 11/2001 |
| WO | WO 2005/102139 | 11/2005 |

* cited by examiner

DOMESTIC APPLIANCE, IN PARTICULAR FITTED DOMESTIC APPLIANCE WITH A CONTROLLABLE OPERATING DISPLAY

BACKGROUND OF THE INVENTION

The invention relates to a fitted domestic appliance, in particular a domestic dishwasher, having an operation indicator that has one or more illumination elements for emitting light beams by means of which a gap formed between the domestic appliance and a surface adjacent to the domestic appliance can be illuminated.

Various domestic appliances are known whose entire front surface is furnished with a front panel that can be matched to surrounding furniture fronts. Domestic appliances of said type include, for instance, ovens, refrigerating devices, and dishwashers. The problem arises with a fully integratable domestic appliance that an optical operation indicator is obscured by the front panel when a front door of the fully integratable domestic appliance is closed so that the operating status of the fully integratable domestic appliance cannot be checked.

Disclosed in DE 100 22 206 C2 is a dishwasher that can be built-in and has a pivoting door having on its upper front surface an optical operation indicator with one or more light sources which, when the appliance door is closed, are obscured by a worktop on top of the dishwasher. Connected there to a vapor-protection element fixed to the underside of the worktop above the appliance door is a light conductor which directs the obscured optical operation indicator's signal light to the front side of the appliance. The disadvantage is that the signal light in the light conductor cannot easily be seen by a user standing in front of the fitted domestic appliance or dishwasher because the light conductor is located in a gap between the underside of the worktop and the edge of the appliance door and is concealed from above by the worktop. The signal light is in particular made more difficult to see when a thick front panel is used because the light conductor will then be additionally concealed from below by the front panel.

To improve the visibility of the signal light of at least one optical operation indicator, DE 102 59 764 A1 proposes embodying the light conductor such that its light route can be adapted to the thickness of the cover element. The light conductor can for that purpose be displaceable relative to the optical operation indicator. The disadvantage thereof is that the light decoupled from the light conductor can differ depending on its position relative to the light source so that the operation indicator's visibility may possibly be worsened.

DE 102 36 211 A1 proposes providing active or passive illumination for an edge or surfaces on the fronts of kitchen-equipment elements. It is intended thereby to enhance the design potential and user-friendliness of individual kitchen-equipment elements as well as for the kitchen equipment overall.

Known from DE 103 03 354 A1 is a lighting system having a series of light-emitting diodes, with said lighting system being embodied as a worktop edge piece, in particular a kitchen worktop edge piece, on whose underside the light-emitting diodes are located. The lighting system can be embodied also as a profiled strip secured in position in the base recess of one or more items of cabinet furniture, in particular lower kitchen cabinets. The purpose is to provide good floor illumination and, in the case of the worktop edge piece, illumination of the cabinet fronts and, additionally, of drawers or other built-in parts. That arrangement is not suitable for controlling an operating-cycle display or for fault signaling.

Known from DE 20 2004 017 690 U1 is a cover plate that is intended for use on items of furniture and whose lighting elements are located in a relatively protected area and emit their light over the front, visible edge of the cover plate. That is achieved using a glass cover plate located on a support. One or more light sources are therein arranged over the entire length on the end face turned away from the observer so that the light penetrates the cover plate and exits it at its front end face.

To be able to tell the current status of a program cycle during the domestic appliance's operation with little effort and without adversely affecting or stopping the domestic appliance, DE 101 44 668 proposes an operating-cycle display in the form of a light strip intended for a washing machine and consisting of a substantial number of lighting elements, with more and more lighting up as the wash program progresses or the rotational speed of the drum increases. Said type of operating-cycle display is not, though, suitable for use in dishwashers, for example, as they do not have a rotating drum. Known furthermore from DE 10 2004 019 329.0, submitted by the applicant, is a controllable operating-cycle display having a number of illumination elements whose individual illumination intensity is controlled as a function of the dishwasher's operation. The operating-cycle display's illumination elements are located in a side surface of the dishwasher or in the edging of a front door of the dishwasher, with its being possible for the light beams produced by the illumination elements to be emitted at least partially indirectly. The illumination elements' being located in the dishwasher's lateral area causes the gaps between the dishwasher and adjacent cabinet components or domestic machines to be illuminated when the illumination elements are lit. The dishwasher's contours will accordingly be at least partially illuminated when the illumination elements are lit. The disadvantage thereof is that if the gaps between the dishwasher and adjacent cabinet component or domestic appliance are very narrow the result for the user will be only limited perceptibility, which can depend on the lighting conditions where the dishwasher is installed and the user's viewing angle relative to the dishwasher.

BRIEF SUMMARY OF THE INVENTION

The object of the present invention is to provide a dishwasher having an operation indicator that indicates an operating status of the dishwasher in a convenient and easy-to-understand manner. The aim therein in particular is for good visibility of the operating-status indicator to be ensured.

An improvement in the visibility of the controllable operation indicator that has one or more illumination elements for emitting light beams by means of which a gap formed between the domestic appliance and a surface adjacent to the domestic appliance can be illuminated is achieved for the inventive fitted domestic appliance in that a reflection element for directing and/or bundling the radiated light emitted by the illumination elements is provided in the gap.

The surface can be an adjacent cabinet component's side wall, an adjacent domestic appliance, or a plate covering the domestic appliance.

The radiated light produced by the illumination elements can be decoupled from the gap in an at least partially directional manner by the reflection element, as a result of which the signal effect will be improved. That is therein possible regardless of how the illumination elements are arranged.

The reflection element is in one embodiment formed by a keder strip that joins the domestic appliance and adjacent surface. That has the advantage that no additional components will need to be provided for directing and/or bundling the radiated light emitted by the illumination elements because a keder strip is usually provided for covering any gap formed between the fitted domestic appliance and adjacent surface. The keder strip can be secured to a side wall of the fitted domestic appliance, its base, or its top. It can be secured using customary methods such as, for example, pasting, clamping, or screwing etc.

It is provided according to a further embodiment for the keder strip, if made of a plastic material, to have a reflecting surface and for said reflecting surface to be formed by means of a reflecting coating on the keder strip or of a color exhibiting a high degree of reflection. The keder strip can according to a further embodiment alternatively already have been produced from a material having a reflecting surface. The keder strip can for that purpose be embodied, for example, as a sheet-metal angle made of stainless steel, for instance.

To ensure at least partially directional decoupling of the radiated light from the gap it is provided according to a further embodiment for the surface shape of the keder strip for redirecting and/or bundling the light beams produced by the illumination elements to be embodied such that said beams will be decoupled from the gap.

The illumination elements can in one embodiment be located in an edging of a front door of the domestic appliance. It is therein preferred for the light beams produced by the illumination elements to be at least partially directed toward the keder strip so that the light beams produced by the illumination elements will be radiated at least partially indirectly.

The illumination elements can also be located in a side wall of the domestic appliance so that the light beams produced by the illumination elements will be radiated at least partially directly. The keder strip can therein be used for example for directing the radiated light produced. The illumination elements can be located in a side-wall end face facing the gap. It is conceivable also for a light source of the illumination element to be located in the side wall of the domestic appliance. To enable a simplified arrangement of the illumination element's light source it is further provided for a light conductor of the illumination element to be located in the side wall of the domestic appliance. It can therein be provided for the light source to be located in the side wall or moving door. The light conductor can be formed by means of, for example, a prism. It is also possible for the illumination elements to be provided with optics that influence the beam path. The optics can in addition to the keder strip-serving as a reflecting surface serve to bundle the beams or to effect scattering.

A further improvement in the operating-status indicator's visibility will be achieved if the gap's wall areas are provided with a reflective surface. Those can be either just the wall areas of the domestic appliance's and/or door's side surface and/or the wall area of the adjacent surface.

According to a further embodiment it is provided for the operation indicator to have differently colored illumination elements, preferably with each color symbolizing a different indication function. The illumination elements can therein be already embodied for emitting differently colored light beams. The coloring can also be influenced by the surface of the keder strip and/or by the reflective surface of the gap's wall areas. The illumination elements can consist of any illuminating means, with light-emitting diodes or ends of optical fibers linked to light sources being particularly suitable owing to the flexibility in the choice of color and ease of control they offer.

For signaling different operating statuses it is furthermore provided for the illumination intensity of the individual illumination elements to be controllable as a function of the domestic appliance's operating status.

The inventive domestic appliance is according to a preferred embodiment a fully integrated dishwasher that can be embodied having a pivoting door. The domestic appliance can also be a drawer dishwasher.

BRIEF DESCRIPTION OF THE DRAWINGS

The invention is explained in more detail below with the aid of the figures.

DETAILED DESCRIPTION OF THE PRESENT INVENTION

Figure 1:
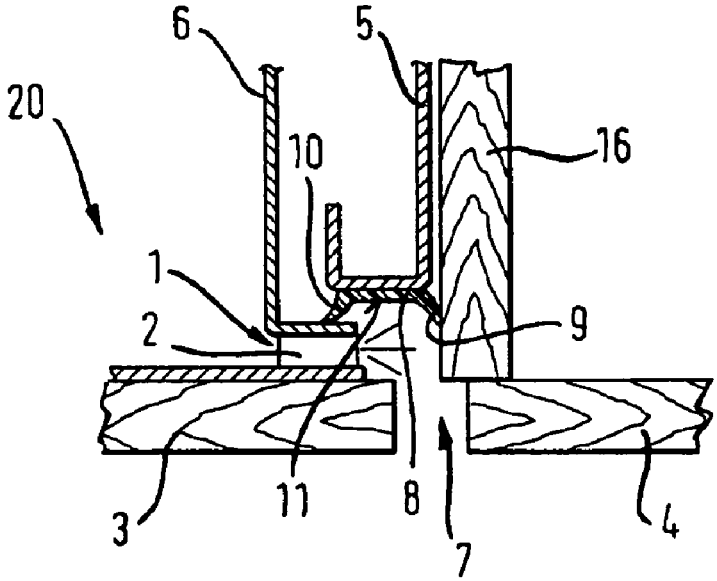
FIG. 1 is a partial sectional view of a dishwasher having an operation indicator according to a first preferred embodiment of the present invention.

FIG. 1 is a sectional top view onto a part of a dishwasher having an operation indicator according to a first embodiment of the invention. The dishwasher is not shown in further detail, just a corner area at which a side wall 5 of the dishwasher and a front door 20 of the dishwasher are applied against each other when the front door 20 is in the closed state. Extending parallel to the dishwasher's side wall 5 is a side wall 16 of a cabinet component or domestic appliance that is adjacent to the dishwasher and with which the dishwasher has been integrated in a row of kitchen units.

The dishwasher and the adjacent cabinet component or domestic appliance are each covered by a front panel, respectively 3 and 4, on the front side of the row of kitchen units. Both front panels 3 and 4 will be mutually aligned in the same plane when the dishwasher's and adjacent cabinet component's or domestic appliance's front door 20 is in the closed position, though with a gap 7 remaining between the lateral abutments of the front panels 3 and 4 to ensure free movement of the front panels 3 and 4. The gap 7 continues between the side wall 16 and the dishwasher depending on how close together the dishwasher's side wall 5 and the adjacent side wall 16 are.

Located in a side section of the dishwasher's front door 20 are a number of illumination elements 1 serving as an operation indicator for indicating the inventive dishwasher's operating cycle and operating status. The illumination elements 1 are driven by an electronic program control (not shown) belonging to the dishwasher, with said control controlling the individual illumination elements' illumination mode and intensity in keeping with the current status of a rinsing-program cycle or an operating status of the dishwasher. The illumination elements hence indicate the dishwasher's current status or condition in the form an optically readily understandable display.

In the embodiment shown in FIG. 1 the front panel 3 covering the dishwasher projects so far beyond the lateral dimensions of the front door 20 as to cover the operation indicator's illumination elements 1 located in the side section of the side wall 6, with the gap 7 up to the cabinet component's or domestic appliance's adjacent front panel 4 remaining. A direct view onto the operation indicator's illumination elements is obscured thereby and the gaps between the dishwasher and adjacent cabinet components or domestic machines will be illuminated when the illumination elements 1 light up. There will be an optically particularly conspicuous display if the illumination elements are disposed along the entire edging of the front door 20, meaning on both sides as well as at the top and bottom.

For improving the operation indicator's perceptibility a reflection element is provided in the gap 7 in the form of a keder strip 8. In the exemplary embodiment shown in FIG. 1 this is embodied as a single piece and extends over an end face of the dishwasher's side wall 5. The keder strip 8 has two keder sections 9 and 10. The keder section 10 facing the front door—and bordering it when the front door 20 is in the closed state—therein serves primarily to reduce noise. The second keder section 9, which borders the cabinet component's or domestic appliance's side wall 16, forms an optical closure so that the gap formed between the dishwasher's side wall 5 and the adjacent cabinet component's or domestic appliance's side wall 16 is not perceptible for a user and is protected against the ingress of dirt. The keder strip 8 is provided with a reflecting surface 11 that can be created by means either of a reflecting coating or of a color exhibiting a high degree of reflection. The keder strip can therein consist in a known manner of a profiled plastic or rubber strip. The keder strip can according to another variant be made from, for example, a sheet-metal angle of stainless steel which, owing to its material characteristics, already has reflective properties. It will then be possible to dispense with separately applying a reflecting surface. By suitably embodying the surface of the keder strip 8, in particular of the keder section 9, the radiated light produced by the illumination element 1 can be redirected and decoupled from the gap 7 in more or less bundled form. The operation indicator's perceptibility will be improved thereby.

In the exemplary embodiment shown in FIG. 1 the illumination element, in particular a light source 2 of the illumination element, is located in the front door 20. In the exemplary embodiment shown in FIG. 2 the illumination element is by contrast provided in the side wall 5, with its being possible for the keder strip 8 to be embodied as a two-piece design, for example. The separate keder sections 9 and 10 serve in that case, corresponding to a headlamp, as a reflector or a beam-bundling element. In contrast to the embodiment of FIG. 1, the illumination element I will remain static in the dishwasher's housing when the door is opened.

Figure 2:
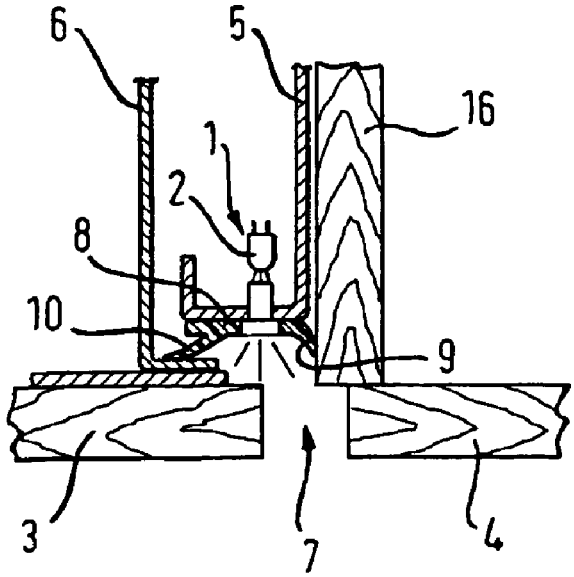
FIG. 2 is a partial sectional view of a dishwasher having an operation indicator according to a second preferred embodiment of the present invention.
Figure 3:
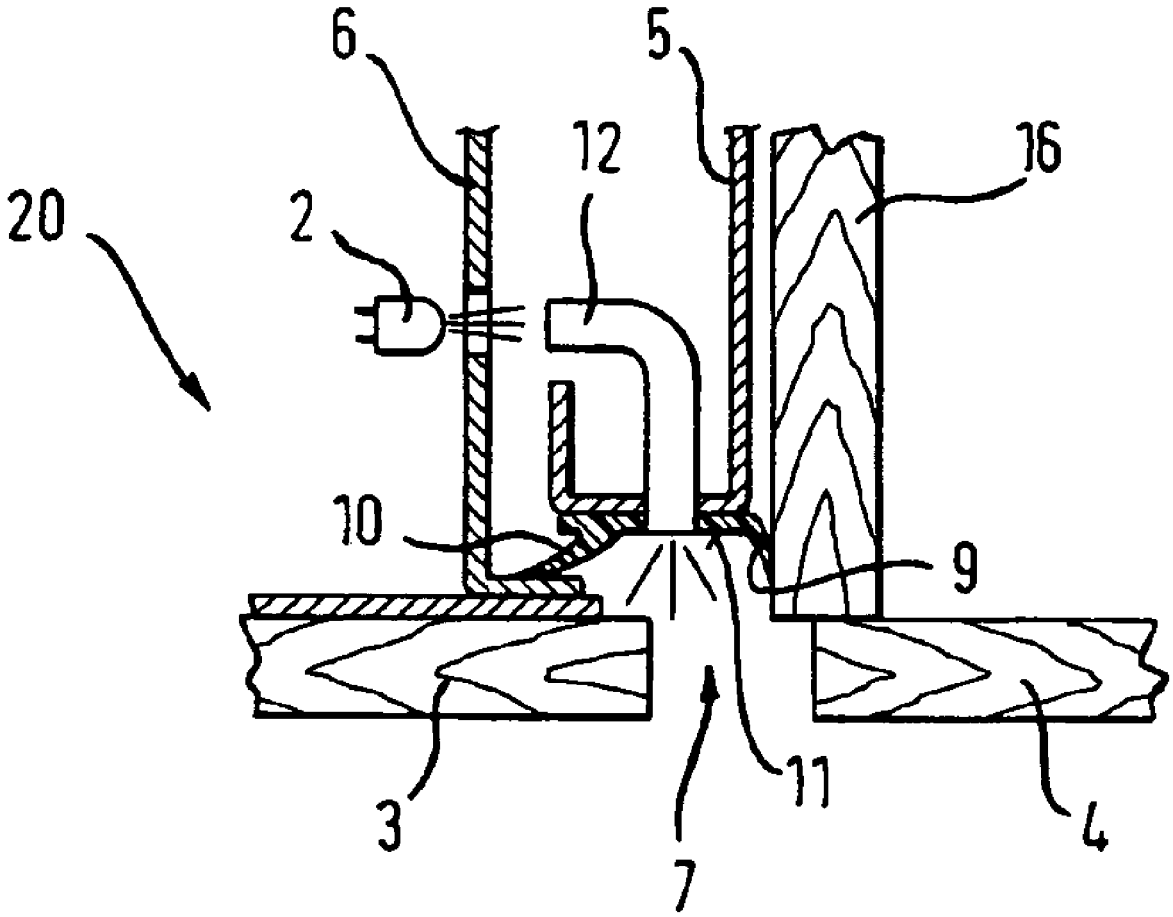
FIG. 3 is a partial sectional view of a dishwasher having an operation indicator according to a third preferred embodiment of the present invention.
Figure 4:
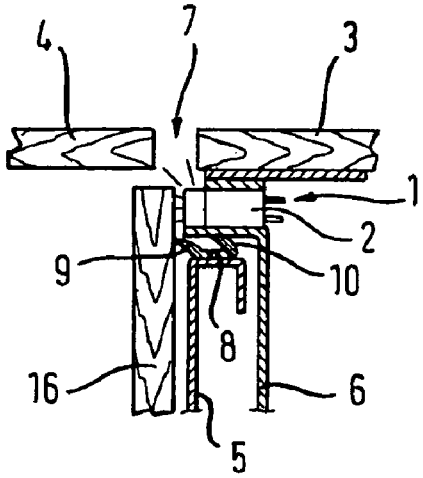
FIG. 4 is a partial sectional view of a dishwasher having an operation indicator according to a fourth preferred embodiment of the present invention.

In the third exemplary embodiment shown in FIG. 3 the illumination element's light source 2 is located in the front door 20. A light conductor 12 is located in the dishwasher's side wall 5 in such a way that a light-coupling surface will be assigned to the light source 2 when the front door 20 is closed. A light-exiting surface of the light conductor 12 is situated in the end face of the front door 5. The keder strip 8, which can be a two-piece embodiment or provided with corresponding recesses for the light conductor 12, forms the reflector surface. What is common to the exemplary embodiments shown in FIGS. 2 and 3 is that at least a part of the light beams produced by the illumination elements 1 can also be decoupled directly from the gap 7.

FIGS. 4 to 9 show further exemplary embodiments of the invention. In the fourth exemplary embodiment shown in FIG. 4 the illumination element 1 projects beyond the front panel 3 so that a part of the radiated light produced by the illumination element 1 is decoupled directly and another part reflectively via the keder section 9 from the gap 7.

Figure 5:
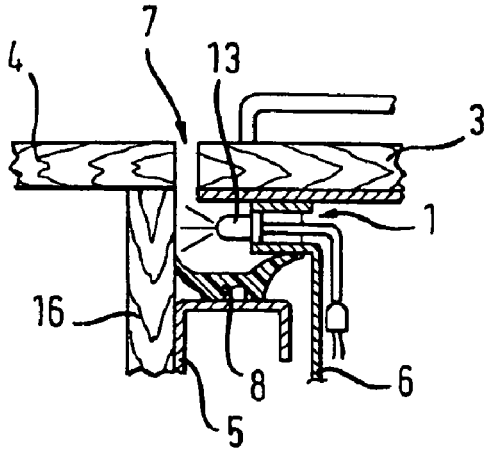
FIG. 5 is a partial sectional view of a dishwasher having an operation indicator according to a fifth preferred embodiment of the present invention.

In the exemplary embodiment shown in FIG. 5 the illumination element is provided with beam-directing optics 13. The beam-directing optics can, if said illumination element has an unfavorable mounting position, be used to direct a part of the radiated light produced onto the keder strip 8 so that the light will be decoupled well from the gap 7.

Figure 6:
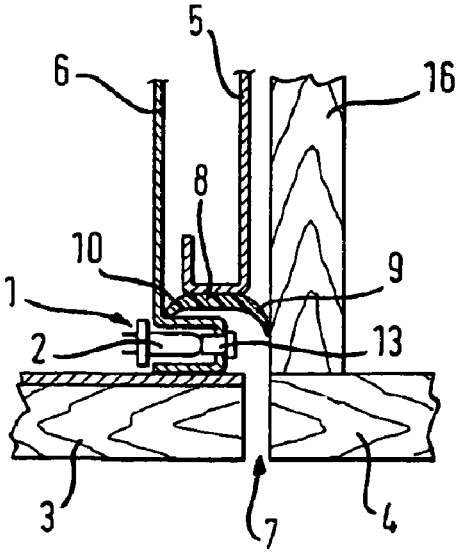
FIG. 6 is a partial sectional view of a dishwasher having an operation indicator according to a sixth preferred embodiment of the present invention.

FIG. 6 shows another embodiment of the illumination element 1 wherein optics for beam directing and beam bundling have likewise been connected upstream of the illumination source 2.

Figure 7:
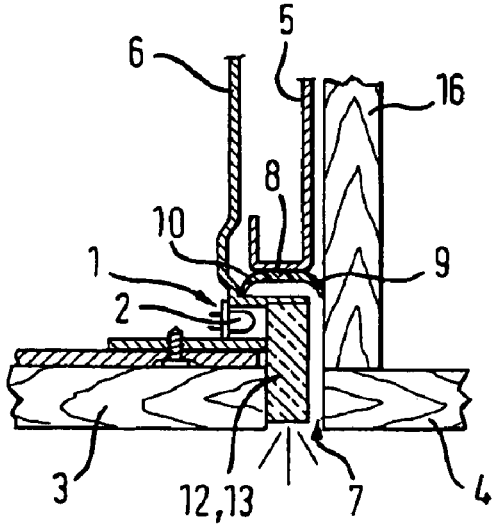
FIG. 7 is a partial sectional view of a dishwasher having an operation indicator according to a seventh preferred embodiment of the present invention.

The optics 13 are in the exemplary embodiment shown in FIG. 7 integrated in a light conductor 12 filling a part of the gap formed between the front panels 3 and 4. This embodiment offers the advantage that the light produced by the illumination elements 1 will be readily perceptible for a user even if the light conditions and viewing angles are unfavorable.

Figure 8:
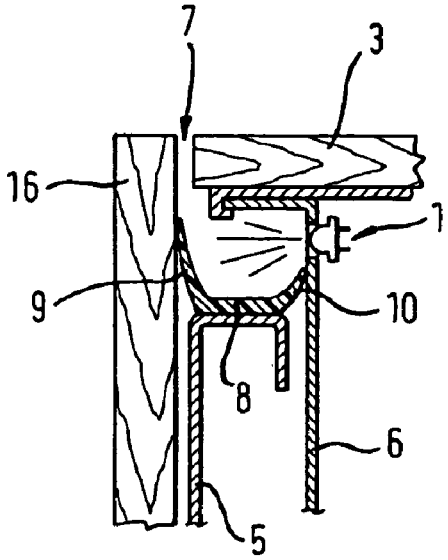
FIG. 8 is a partial sectional view of a dishwasher having an operation indicator according to an eighth preferred embodiment of the present invention.

FIG. 8 shows a variant of the exemplary embodiment shown in FIG. 1 wherein the illumination element 1 in the side wall 6 of the front door 20 is in a structurally different location.

Figure 9:
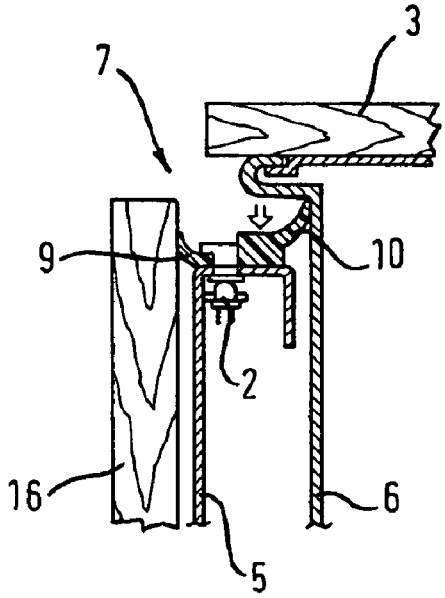
FIG. 9 is a partial sectional view of a dishwasher having an operation indicator according to a ninth preferred embodiment of the present invention.

FIG. 9 shows a further design variant wherein the illumination element 1 is located in the dishwasher's side wall 5 and the keder section 10 at the same time embodies a buffer when the front door 20 is closed.

Figure 10:
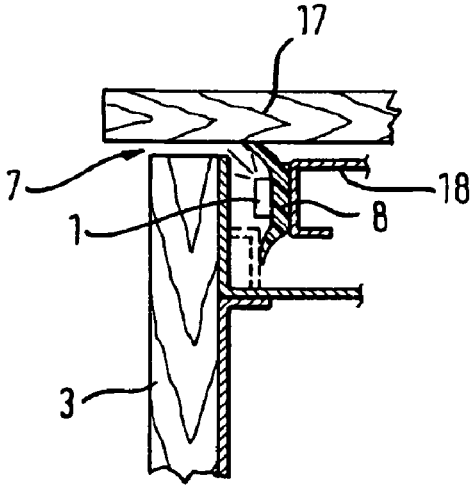
FIG. 10 is a partial sectional view of a dishwasher having an operation indicator according to a tenth preferred embodiment of the present invention.
Figure 11:
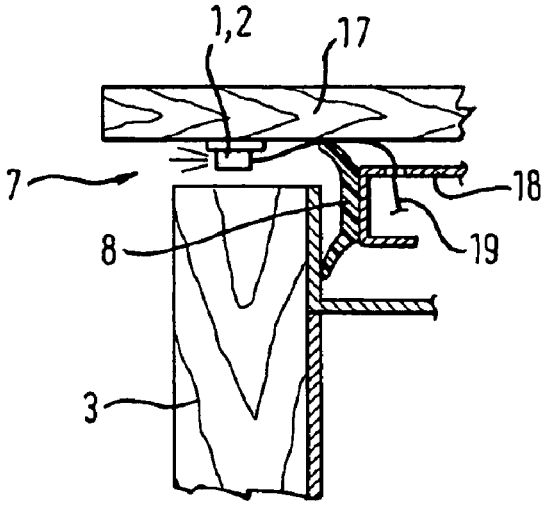
FIG. 11 is a partial sectional view of a dishwasher having an operation indicator according to an eleventh preferred embodiment of the present invention.

FIGS. 10 and 11 are partial sectional views of the dishwasher from the side. Both embodiments show that the illumination elements 1 can be used also for illuminating the gap 7 formed between the front panel 3 and a cover plate 17 of the dishwasher. In keeping with the exemplary embodiments previously described, the end face of a housing top 18 is likewise provided with a keder strip. In the exemplary embodiment shown in FIG. 10 the illumination element 1 is attached to the keder strip, with the keder section facing the cover plate 17 serving as a reflection element.

FIG. 11 shows a further embodiment wherein the light source 2 of the illumination element 1 is located on the underside of the cover plate 17—outside the dishwasher's housing. The illumination element is electrically contacted via a cable 19 ducted between the cover plate 17 and keder strip 8 into the dishwasher housing's interior. That variant allows the light beams to be decoupled directly from the gap 7, with its being possible to flexibly accommodate the illumination element according to the specific structural circumstances.

The dishwasher's side wall area and/or the adjacent surface's side wall area can in all variants described be provided likewise with a reflective surface for improving decoupling of the light beams produced by the illumination elements.

The invention claimed is:

1. A domestic appliance comprising:

an operation indicator having an illumination element for emitting a light beam by means of which a gap between the domestic appliance and a surface adjacent to the domestic appliance can be illuminated; and a reflection element in the gap for directing or bundling light emitted by the illumination element.

2. The domestic appliance of claim 1, wherein the reflection element comprises a finishing strip joining the domestic appliance and the adjacent surface.

3. The domestic appliance of claim 2, wherein the keder strip comprises one of a reflecting coating on the finishing strip and a color exhibiting a high degree of reflection.

4. The domestic appliance of claim 2, where the finishing strip comprises a material having a reflecting surface.

5. The domestic appliance of claim 2, wherein a surface shape of the finishing strip decouples the light beam from the gap.

6. The domestic appliance of claim 1, wherein the illumination elements is in an edging of a front door of the domestic appliance.

7. The domestic appliance of claim 6, wherein the light beam produced by the illumination element is at least partially directed onto the reflection element so that the light beams produced by the illumination elements will be emitted at least partially indirectly.

8. The domestic appliance of claim 1, wherein the illumination element is in a side wall of the domestic appliance so that the light beam produced by the illumination element is emitted at least partially directly.

9. The domestic appliance of claim 8, wherein the illumination element is in a side-wall end face facing the gap.

10. The domestic appliance of claim 8, wherein a light source of the illumination element is in a side wall of the domestic appliance.

11. The domestic appliance of claim 8, further comprising a light conductor of the illumination element in a side wall of the domestic appliance.

12. The domestic appliance of claim 11, wherein the light source is in a side wall or a moving front door of the domestic appliance.

13. The domestic appliance of claim 11, wherein the light conductor comprises a prism.

14. The domestic appliance of claim 1, wherein the illumination element comprises optics that influence a beam path.

15. The domestic appliance of claim 1 wherein wall areas of the gap comprise a reflective surface.

16. The domestic appliance of claim 1, wherein the operation indicator comprises differently colored illumination elements with each color symbolizing a different indication function.

17. The domestic appliance as claimed in claim 16, wherein the illumination elements emit differently colored light beams.

18. The domestic appliance of claim 16, wherein a color visible by a user is influenced by the reflection element.

19. The domestic appliance of claim 1, wherein an illumination intensity of the illumination element is a function of an operating status of the domestic appliance.

20. The domestic appliance of claim 1, wherein the domestic appliance comprises a fully integrated dishwasher.

21. The domestic appliance of claim 1, wherein the domestic appliance comprises a drawer dishwasher.

* * * * *